US011665479B2

(12) United States Patent
Zhong et al.

(10) Patent No.: US 11,665,479 B2
(45) Date of Patent: May 30, 2023

(54) SOUNDING DEVICE

(71) Applicant: AAC Microtech (Changzhou) Co., Ltd., Changzhou (CN)

(72) Inventors: Zhiwei Zhong, Shenzhen (CN); Xin Jin, Shenzhen (CN)

(73) Assignee: AAC Microtech (Changzhou) Co., Ltd., Changzhou (CN)

( * ) Notice: Subject to any disclaimer, the term of this patent is extended or adjusted under 35 U.S.C. 154(b) by 0 days.

(21) Appl. No.: 17/535,715

(22) Filed: Nov. 26, 2021

(65) Prior Publication Data

US 2022/0174412 A1 Jun. 2, 2022

(30) Foreign Application Priority Data

Nov. 30, 2020 (CN) ..... 202022846392.7

(51) Int. Cl.
*H04R 9/02* (2006.01)
*H04R 7/18* (2006.01)

(52) U.S. Cl.
CPC ..... *H04R 9/025* (2013.01); *H04R 7/18* (2013.01); *H04R 2400/11* (2013.01)

(58) Field of Classification Search
CPC ..... H04R 7/18; H04R 9/025; H04R 2400/11
See application file for complete search history.

(56) References Cited

U.S. PATENT DOCUMENTS

2017/0280247 A1* 9/2017 Kobayashi ..... H04R 7/12

FOREIGN PATENT DOCUMENTS

CN 109362005 A * 2/2019 ..... H04R 9/025

* cited by examiner

*Primary Examiner* — Sunita Joshi
(74) *Attorney, Agent, or Firm* — W&G Law Group

(57) ABSTRACT

A sounding device includes a frame, and a vibration system and a magnetic circuit unit that are retained in the frame. The vibration system includes diaphragm and voice coil. The voice coil includes two first side edges and two second side edges. The magnetic circuit unit includes yoke, main magnetic body, and auxiliary magnetic body. The auxiliary magnetic body includes first auxiliary magnetic bodies each including main body portion and extension portion. The main body portion is recessed towards side surfaces of two first side edges to form grooves, the main magnetic body protrudes towards the grooves, and the pair of first side edges protrude towards the grooves, respectively. The sounding device can not only enable the auxiliary magnetic body to be more evenly surrounding the voice coil, but also enable the voice coil to have longer circumference with a same magnetic circuit area, thereby increasing BL value.

14 Claims, 8 Drawing Sheets

SOUNDING DEVICE

TECHNICAL FIELD

The disclosure relates to the field of electroacoustic conversion, and in particular, to a sounding device.

BACKGROUND

In order to adapt to miniaturization and multi-function development of various audio devices and information communication devices, sounding devices used in such devices are required to be more miniaturized correspondingly, so that the sounding devices fit with other surrounding elements more compactly. Especially with the development of thinness of mobile phones, increasingly high requirements are put forward on the quality of the sounding devices used therein.

In the related art, the sounding device includes a frame, and a vibration system and a magnetic circuit unit that are retained in the frame, the vibration system includes a diaphragm retained in the frame and a voice coil configured to drive the diaphragm to vibrate to produce sound, the voice coil includes a pair of first side edges and a pair of second side edges, the magnetic circuit unit includes an auxiliary magnetic body opposite to and spaced apart from the first side edge, and the auxiliary magnetic body includes a main body portion and an extension portion formed by extending from one side of the main body portion away from the first side edge. However, the extension portion is far away from the voice coil, resulting in low magnetic utilization.

Therefore, there is a need to provide a sounding device to solve the above problems.

SUMMARY

An objective of the disclosure is to provide a sounding device which can not only enable the auxiliary magnetic body to be more evenly around the voice coil, but also enable the voice coil to have a longer circumference with a same magnetic circuit area, thereby increasing a BL value.

A sounding device according to the disclosure includes a frame, and a vibration system and a magnetic circuit unit that are retained in the frame. The vibration system includes a diaphragm retained in the frame and a voice coil configured to drive the diaphragm to vibrate to produce sound. The voice coil includes a pair of first side edges and a pair of second side edges that are connected between the pair of first side edges. The magnetic circuit unit includes a yoke, a main magnetic body fixed to the yoke, and an auxiliary magnetic body surrounding the main magnetic body and forming a magnetic gap with the main magnetic body. The auxiliary magnetic body includes first auxiliary magnetic bodies opposite to and spaced apart from the pair of first side edges. Each of the first auxiliary magnetic bodies includes a main body portion and an extension portion formed by extending from one side of the main body portion away from one first side edge of the pair of first side edges. The main body portion is recessed toward side surfaces of the pair of first side edges to form grooves, the main magnetic body protrudes towards the grooves, and the pair of first side edges protrude towards the grooves, respectively.

As an improvement, a protruding shape of the main magnetic body and a protruding shape of each of the pair of first side edges match a shape of each of the grooves.

As an improvement, an elastic supporter connected to the vibration system is fixed to the frame, each of the first auxiliary magnetic bodies is located between the elastic supporter and one first side edge of the pair of first side edges, the elastic supporter comprises an auxiliary diaphragm, the auxiliary diaphragm is provided with an avoiding slot avoiding the extension portion, the auxiliary diaphragm comprises a first fixed portion fixed to the frame, a second fixed portion connected to the vibration system, and a suspension portion connecting the first fixed portion with the second fixed portion, and the avoiding slot extends from the second fixed portion to the suspension portion.

As an improvement, the elastic supporter further includes a flexible printed circuit board, and the flexible printed circuit board includes a retaining portion connected to the first fixed portion, a bonding portion fixed to the second fixed portion, and an elastic arm connecting the retaining portion with the bonding portion. An opening of the suspension portion faces towards the flexible printed circuit board, and an orthographic projection of the elastic arm on the auxiliary diaphragm is located within the suspension portion.

As an improvement, the flexible printed circuit board is located between the auxiliary diaphragm and the diaphragm.

As an improvement, a framework is connected to one side of the diaphragm facing towards the voice coil, and the voice coil and the elastic supporter each are connected to the framework.

As an improvement, the framework includes a framework main body fixed to the diaphragm, a first connection portion, and a second connection portion. An outer periphery of the framework main body extends away from the diaphragm to form the first connection portion, an inner periphery of the framework main body extends away from the diaphragm to form the second connection portion, the elastic supporter is connected to the first connection portion, and the voice coil is connected to the second connection portion.

As an improvement, notches are formed at the second connection portion, and the second connection portion are separated by notches into a plurality of isolation islands that is spaced apart from each other, and the voice coil is fixed to the plurality of isolation islands.

As an improvement, the magnetic circuit unit further includes an upper clamp plate covering the auxiliary magnetic body and fixed to the frame, and a pole plate covering the main magnetic body, wherein the upper clamp plate has a through hole where the pole plate is located.

Compared with the related art, in the sounding device according to the disclosure, the first side edge of the voice coil, the main magnetic body, and the first auxiliary magnetic body are designed in such a manner that the main body portion is recessed toward a side surface of the first side edge to form the groove and both the main magnetic body and the first side edge protrude towards the groove. In this way, the sounding device can not only enable the first auxiliary magnetic body to surround the voice coil more evenly, but also enable the voice coil to have a longer circumference with a same magnetic circuit area, thereby increasing BL value.

DESCRIPTION OF EMBODIMENTS

Figure 1:
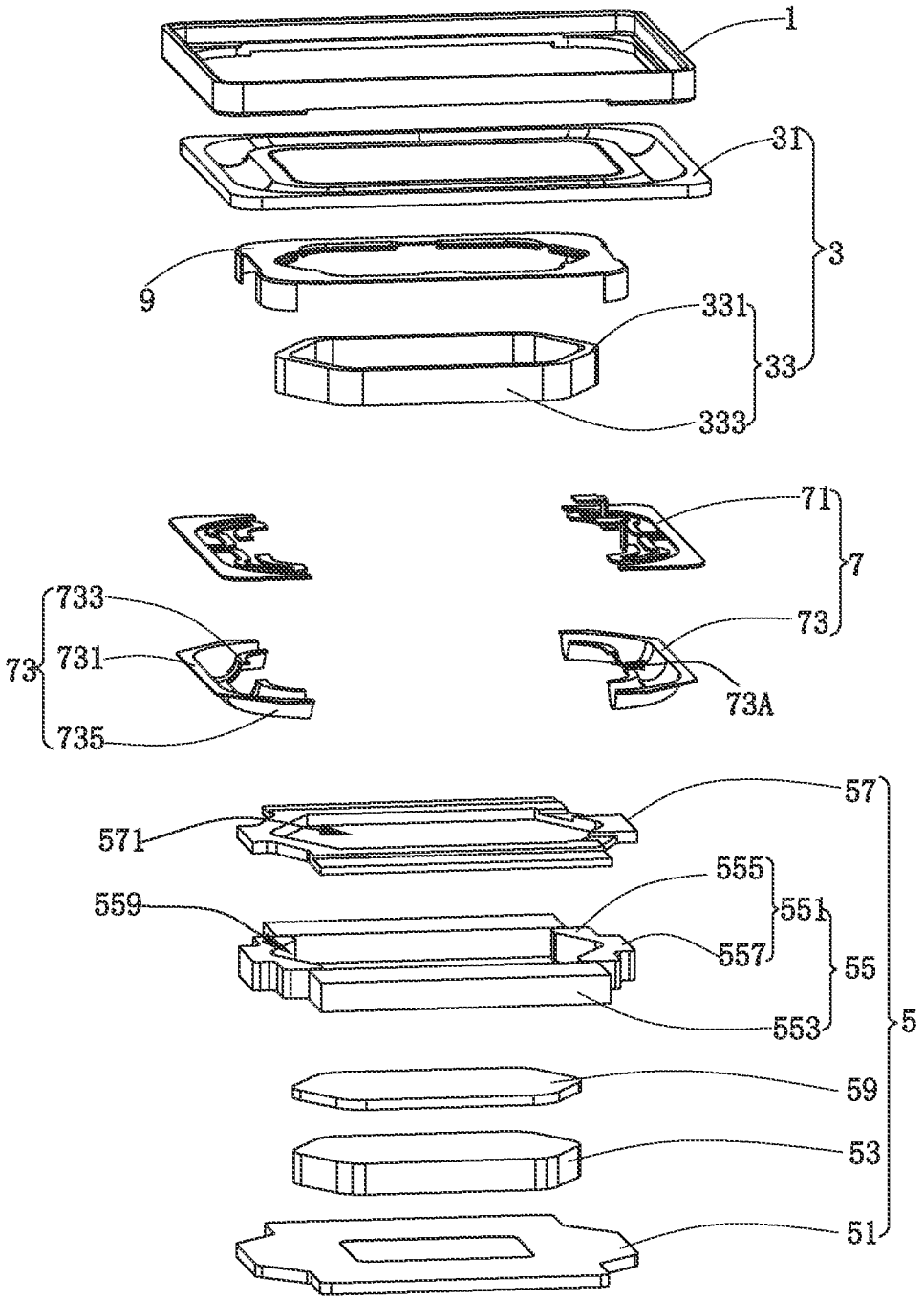
FIG. 1 is a schematic exploded perspective view of a preferred embodiment of a sounding device according to the disclosure.
Figure 2:
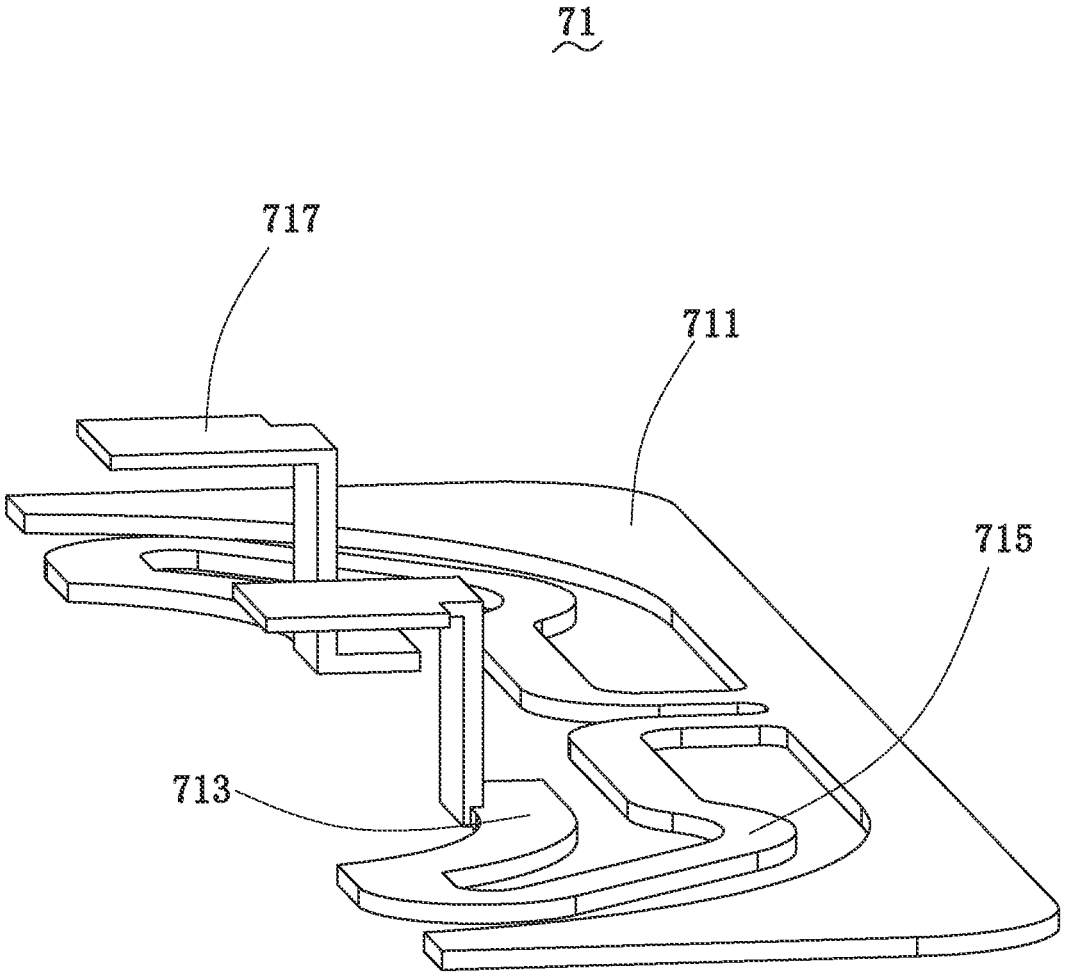
FIG. 2 is a schematic structural diagram of a flexible printed circuit board in the sounding device shown in FIG. 1.
Figure 3:
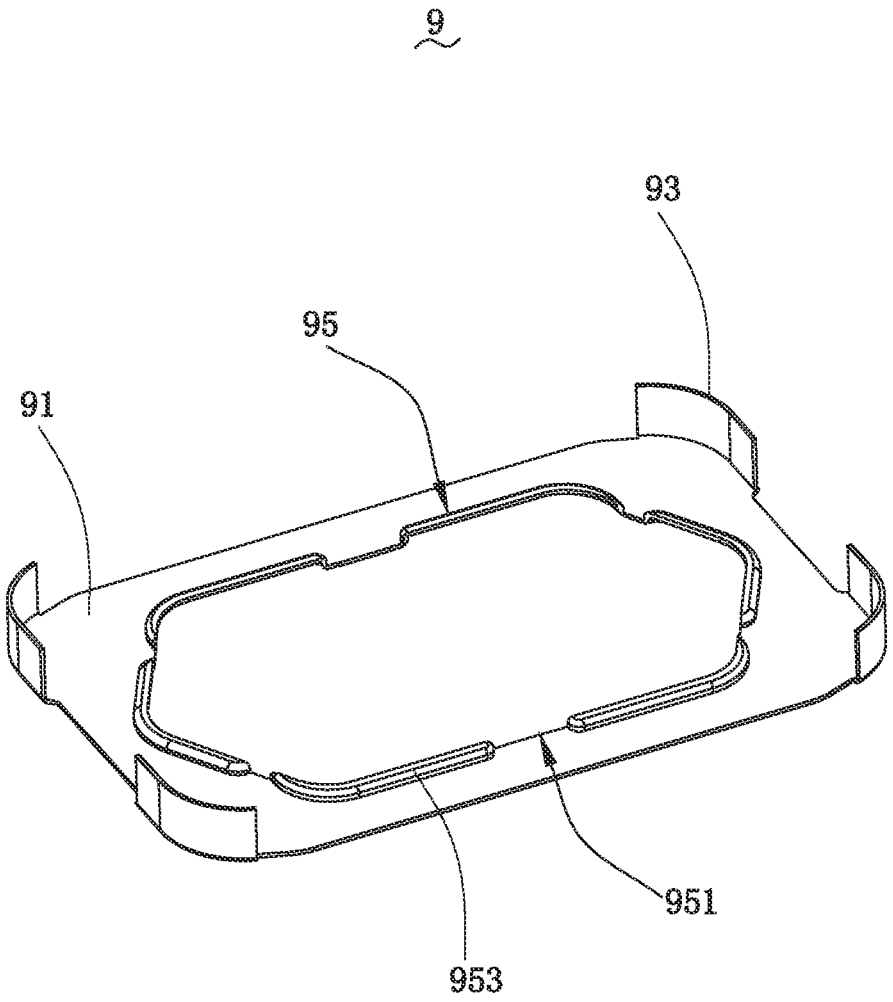
FIG. 3 is a schematic structural diagram of a framework in the sounding device shown in FIG. 1.
Figure 4:
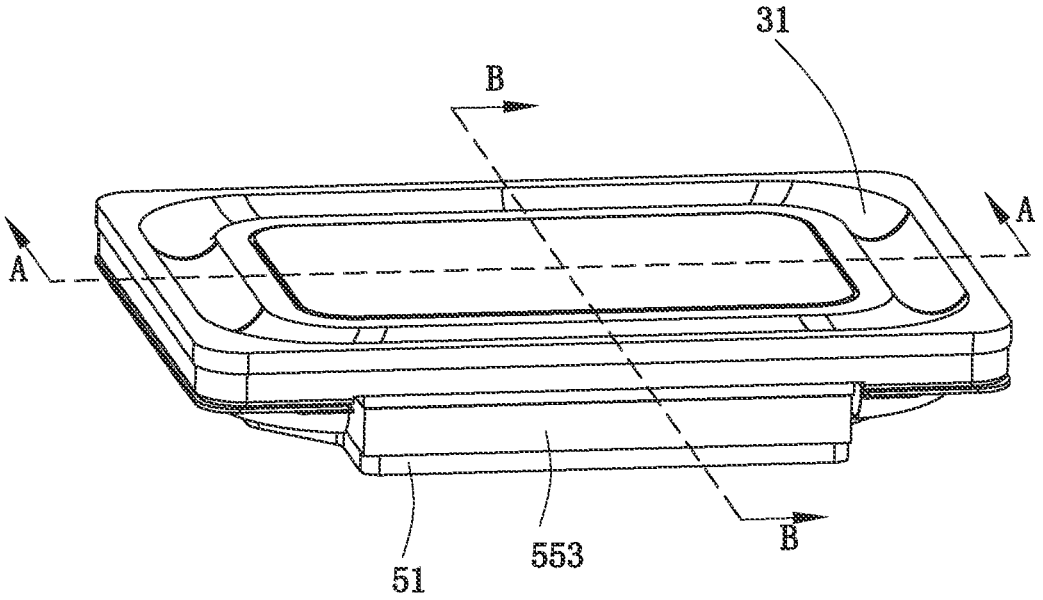
FIG. 4 is a perspective view after assembly of the sounding device shown in FIG. 1.

The technical solutions in the embodiments of the disclosure will be described clearly and completely below with reference to the accompanying drawings in the embodiments of the disclosure. The described embodiments are merely some of rather than all of the embodiments of the disclosure. All other embodiments acquired by those skilled in the art based on the embodiments of the disclosure shall fall within the protection scope of the disclosure.

As shown in FIG. 1 to FIG. 8, the sounding device includes a frame 1, and a vibration system 3 and a magnetic circuit unit 5 that are fixed to the frame 1. The magnetic circuit unit 5 is configured to drive the vibration system 3 to vibrate to produce sound.

The vibration system 3 includes a diaphragm 31 retained in the frame 1, and a voice coil 33 configured to drive the diaphragm 31 to vibrate to produce sound. The voice coil 33 is connected to an external circuit. After the voice coil 33 is energized, the voice coil 33 vibrates under a magnetic field of the magnetic circuit unit 5. Meanwhile, the voice coil 33 drives the diaphragm 31 to vibrate to produce sound.

Figure 7:
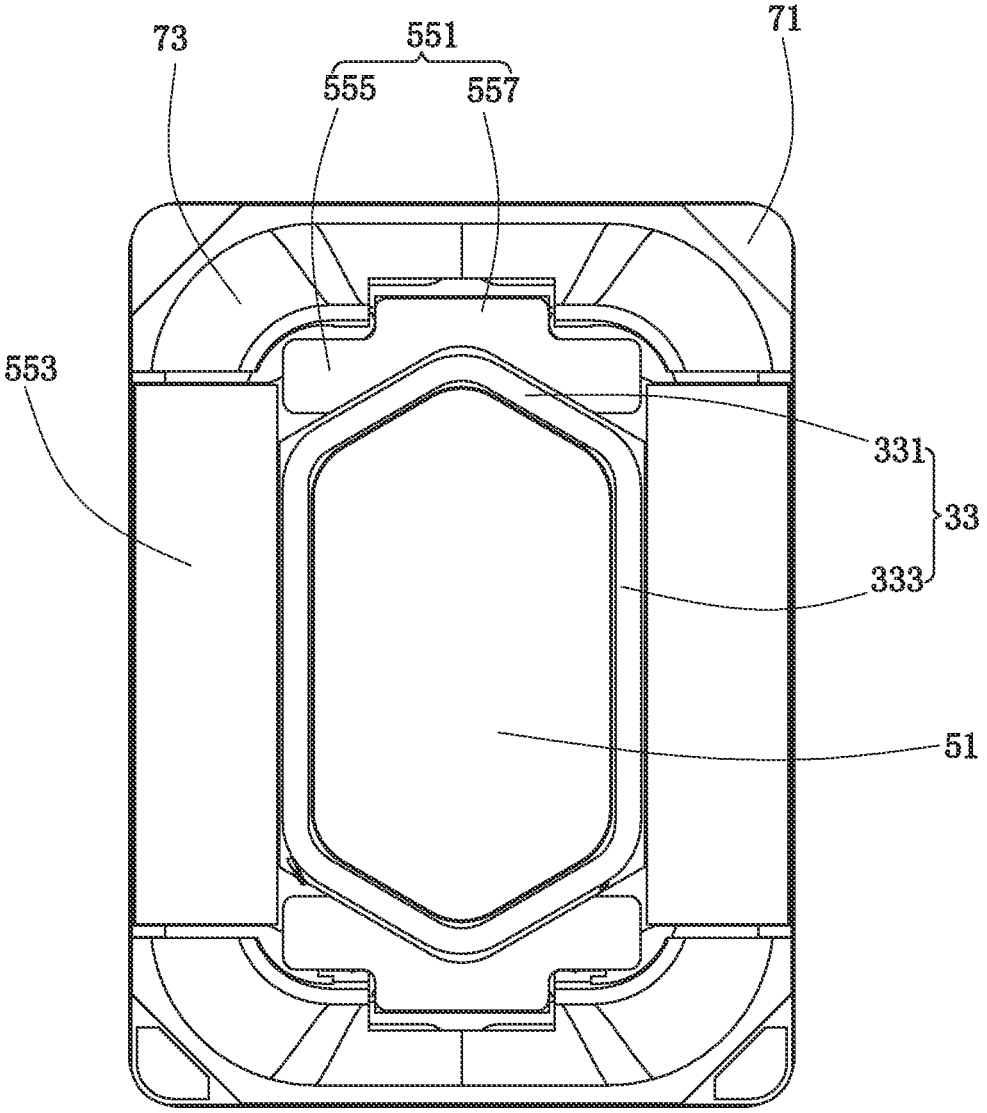
FIG. 7 is a schematic structural diagram of the sounding device shown in FIG. 4 after removal of a yoke.

The voice coil 33 includes a pair of first side edges 331 and a pair of second side edges 333 connected between the first side edges 331. As shown in FIG. 1 and FIG. 7, the first side edge 331 is located in a direction of a major axis of the sounding device, and the second side edge 333 is located in a direction of a minor axis of the sounding device.

An elastic supporter 7 connected to the vibration system 3 is fixed to the frame 1.

In an embodiment, a framework 9 is connected to one side of the diaphragm 31 facing towards the voice coil 33, and the voice coil 33 and the elastic supporter 7 are connected to the framework 9. The voice coil 33, when vibrating, drives the diaphragm 31, the framework 9, and the elastic supporter 7 to vibrate together.

The framework 9 includes a framework main body 91 fixed to the diaphragm 31, a first connection portion 93, and a second connection portion 95. An outer periphery of the framework main body 91 extends away from the diaphragm 31 to form the first connection portion 93, and an inner periphery of the framework main body 91 extends away from the diaphragm 31 to form the second connection portion 95. The elastic supporter 7 is connected to the first connection portion 93 to connect the elastic supporter 7 with the vibration system 3. The voice coil 33 is connected to the second connection portion 95.

It can be understood that, in other embodiments, no framework is provided. Correspondingly, the voice coil is fixed to the diaphragm, and one end of the elastic supporter away from the frame is fixed to one side of the voice coil away from the diaphragm, so as to connect the elastic supporter with the vibration system.

In an embodiment, multiple notches 951 are formed at the second connection portion 95, the second connection portion 95 are separated by the multiple notches 951 into multiple isolation islands 953, multiple isolation islands 953 are spaced apart from each other, and the voice coil 33 is fixed to the isolation islands 953.

The elastic supporter 7 includes a flexible printed circuit board 71 and an auxiliary diaphragm 73 stacked along a vibrating direction of the diaphragm 31.

Figure 5:
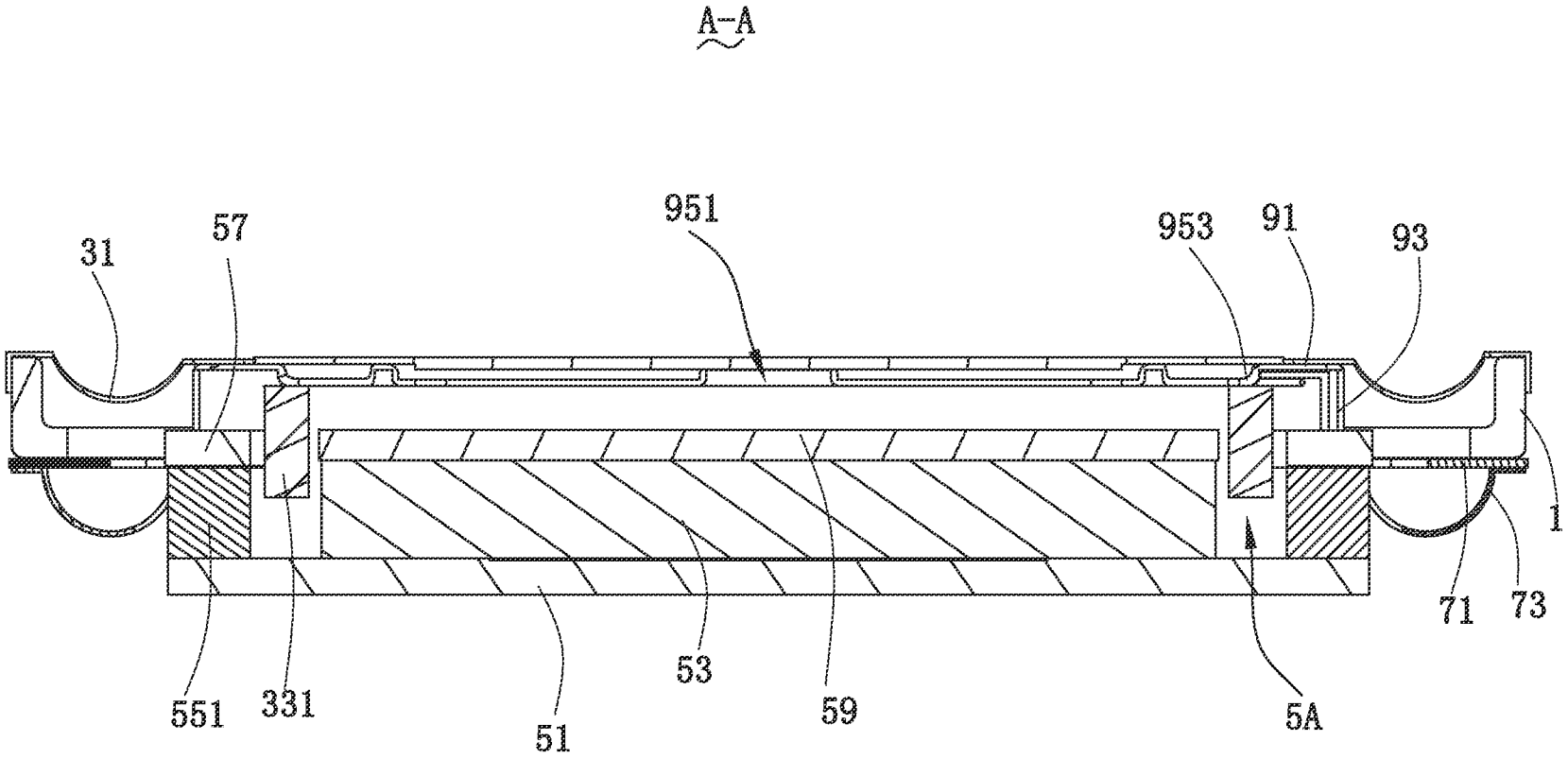
FIG. 5 is a sectional view of a sounding device along line A-A shown in FIG. 4.
Figure 6:
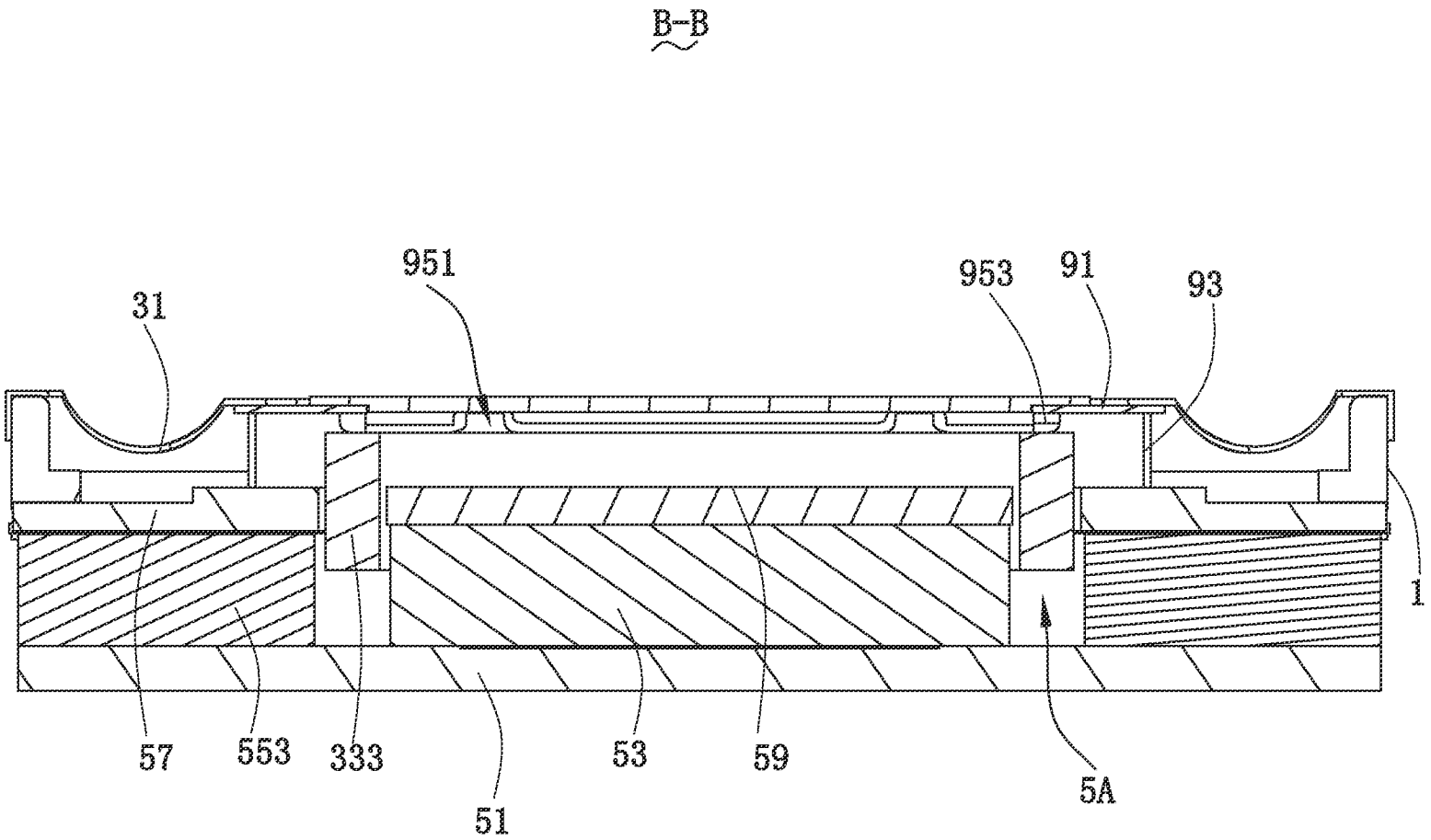
FIG. 6 is a sectional view of a sounding device along line B-B shown in FIG. 4.

As shown in FIG. 5, the flexible printed circuit board 71 is located between the auxiliary diaphragm 73 and the diaphragm 31.

The flexible printed circuit board 71 includes a retaining portion 711 fixed to the frame 1, a bonding portion 713 fixed to the first connection portion 93, and an elastic arm 715 connecting the retaining portion 711 with the bonding portion 713.

In an embodiment, one of the flexible printed circuit boards 71 further includes a pad portion 717 bending and extending from the bonding portion 713 towards the diaphragm 31, and the pad portion 717 is provided with a pad electrically connected to the lead wire of the voice coil 33. On the one hand, the flexible printed circuit board 71 has a function of supporting and fixing the vibration system 3. On the other hand, the retaining portion 711 and the pad portion 717 of the flexible printed circuit board 71 are each provided with a pad. Conductive paths are arranged in the elastic arm 715 and the bonding portion 713 to be electrically connected to the pads on the retaining portion 711 and the pad portion 717. The pad on the pad portion 717 is connected to the lead wire of the voice coil 33 to electrically connect the voice coil 33. The pad on the retaining portion 711 is connected to an external circuit so that the voice coil 33 is electrically connected to the external circuit through the flexible printed circuit board 71, and when the sounding device operates, an electric signal of the external circuit is transmitted to the voice coil 33 through the flexible printed circuit board 71.

It can be understood that, in other embodiments, the flexible printed circuit board 71 can be provided with no pad portion. Correspondingly, the pad electrically connected to the lead wire of the voice coil 33 is arranged on the bonding portion.

The auxiliary diaphragm 73 includes a first fixed portion 731 fixed to one side of the retaining portion 711 away from the frame 1, a second fixed portion 733 fixed to one side of the bonding portion 713 away from the first connection portion 93, and a suspension portion 735 connecting the first fixed portion 731 with the second fixed portion 733. An opening of the suspension portion 735 faces towards the flexible printed circuit board, and an orthographic projection of the elastic arm 715 on the auxiliary diaphragm 73 is located within the suspension portion 735. That is, the first fixed portion 731 of the auxiliary diaphragm 73 is fixed to the frame 1 through the retaining portion 711, and the second fixed portion 733 of the auxiliary diaphragm 73 is fixed to the first connection portion 353 through the bonding portion 713.

It can be understood that, in other embodiments, the elastic supporter can also be designed in such a manner that the auxiliary diaphragm is located between the flexible printed circuit board and the diaphragm. Correspondingly, the opening of the suspension portion should faces away from the diaphragm. In an embodiment, the elastic supporter includes only the auxiliary diaphragm.

The magnetic circuit unit 5 includes a yoke 51, a main magnetic body 53 fixed to the yoke 51, an auxiliary magnetic body 55, an upper clamp plate 57 covering the auxiliary magnetic body 55, and a pole plate 59 covering the main magnetic body 53. The auxiliary magnetic body 55 surrounds the main magnetic body 53 and forms a magnetic gap 5A with the main magnetic body 53. The upper clamp plate 57 is retained on the frame 1 to retain the magnetic circuit unit 5 on the frame 1. The voice coil 33 is inserted in the magnetic gap 5A, so that after the voice coil 33 is energized, the voice coil 33 can vibrate under the magnetic field of the magnetic circuit unit 5. The upper clamp plate 57 has a through hole 571, and the pole plate 59 is located in the through hole 571.

In an embodiment, both the upper clamp plate 57 and the pole plate 59 are made of a magnetically conductive material, so as to enhance a magnetic flux within the magnetic gap 5A.

Figure 8:
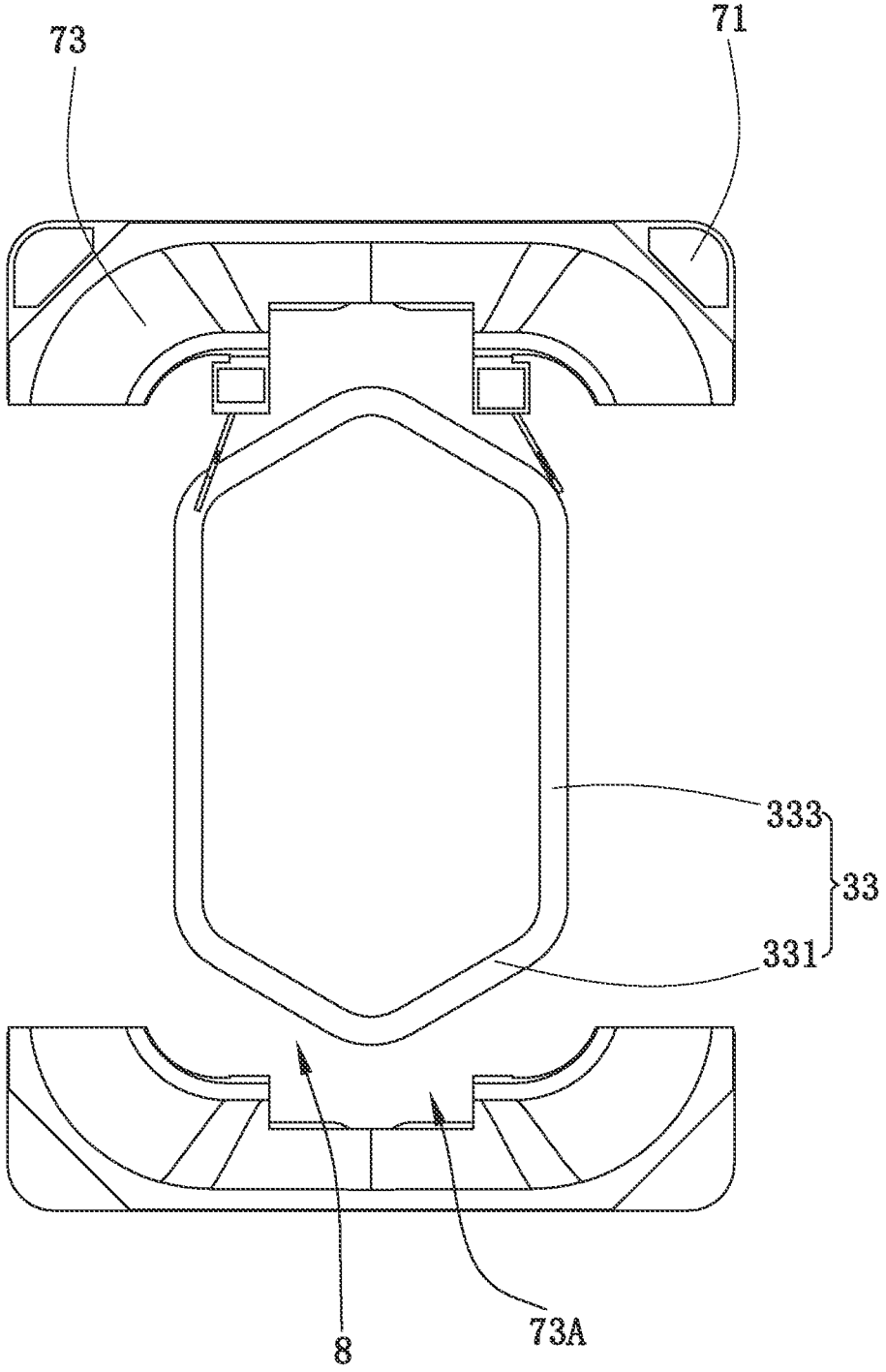
FIG. 8 is a schematic structural diagram after assembly of an elastic supporter and a voice coil in the sounding device shown in FIG. 1.

The auxiliary magnetic body 55 includes a first auxiliary magnetic body 551 and a second auxiliary magnetic body 553 spaced apart from the second side edge 333, the first auxiliary magnetic body 551 is opposite to and spaced apart from the first side edge 331 and located between the elastic supporter 7 and the first side edge 331. As shown in FIG. 8, a space 8 is formed between the elastic supporter 7 and the first side edge 331 and configured to place the first auxiliary magnetic body 551.

The first auxiliary magnetic body 551 includes a main body portion 555 and an extension portion 557 formed by extending from one side of the main body portion 555 away from the first side edge 331. The auxiliary diaphragm 73 is provided with an avoiding slot 73A configured to avoid the extension portion 557, and the avoiding slot 73A extends from the second fixed portion 733 to the suspension portion 735.

The main body portion 555 is recessed toward a side surface of the first side edge 331 to form a groove 559, and both the main magnetic body 53 and the first side edge 331 protrude towards the groove 559.

In an embodiment, a protruding shape of the main magnetic body 53 and a protruding shape of the first side edge 331 match a shape of the groove 559. As shown in FIG. 7, the groove 559 is in a shape of a triangle. It can be understood that the shape of the groove 559 is not limited thereto, which can also be, for example, a trapezoid, an arc or the like.

In an embodiment, the main magnetic body 53, the first auxiliary magnetic body 551, and the second auxiliary magnetic body 553 are all magnets. In other embodiments which include the main magnetic body 53, the first auxiliary magnetic body 551 and the second auxiliary magnetic body 553, two main magnetic bodies 53 can be two main magnets stacked along a vibrating direction of the diaphragm 31 and having opposite polarities. Correspondingly, the first auxiliary magnetic body 551 and the second auxiliary magnetic body 553 each can include two auxiliary magnets stacked along the vibrating direction of the diaphragm 31 and having opposite polarities, and in an embodiment, magnetic conduction plates made of a magnetically conductive material can be sandwiched between the two main magnets and between the two auxiliary magnets.

In other embodiments, the magnetic circuit unit 5 can be provided with no pole plate and no upper clamp plate. Correspondingly, the second auxiliary magnetic body is fixed to the frame to fix the magnetic circuit unit to the frame.

The above illustrates only some embodiments of the disclosure. It should be pointed out that those of ordinary skill in the art may also make improvements without departing from the ideas of the disclosure, all of which fall within the protection scope of the disclosure.

What is claimed is:

1. A sounding device, comprising:

a frame; and a vibration system and a magnetic circuit unit that are retained in the frame, wherein the vibration system comprises a diaphragm retained in the frame and a voice coil configured to drive the diaphragm to vibrate to produce sound, wherein the voice coil comprises a pair of first side edges and a pair of second side edges that are connected between the pair of first side edges;

the magnetic circuit unit comprises a yoke, a main magnetic body fixed to the yoke, and an auxiliary magnetic body surrounding the main magnetic body and forming a magnetic gap with the main magnetic body, wherein the auxiliary magnetic body comprises first auxiliary magnetic bodies opposite to and spaced apart from the pair of first side edges, each of the first auxiliary magnetic bodies comprises a main body portion and an extension portion formed by extending from one side of the main body portion away from one first side edge of the pair of first side edges, wherein the main body portion is recessed toward side surfaces of the pair of first side edges to form grooves, the main magnetic body protrudes towards the grooves, and the pair of first side edges protrude towards the grooves, respectively;

wherein an elastic supporter connected to the vibration system is fixed to the frame, each of the first auxiliary magnetic bodies is located between the elastic supporter and one first side edge of the pair of first side edges, the elastic supporter comprises an auxiliary diaphragm, the auxiliary diaphragm is provided with an avoiding slot configured to avoid the extension portion, the auxiliary diaphragm comprises a first fixed portion fixed to the frame, a second fixed portion connected to the vibration system, and a suspension portion connecting the first fixed portion with the second fixed portion, and the avoiding slot extends from the second fixed portion to the suspension portion.

2. The sounding device as described in claim 1, wherein a protruding shape of the main magnetic body and a protruding shape of each of the pair of first side edges match a shape of each of the grooves.

3. The sounding device as described in claim 1, wherein a framework is connected to one side of the diaphragm facing towards the voice coil, and the voice coil and the elastic supporter each are connected to the framework.

4. The sounding device as described in claim 3, wherein the framework comprises a framework main body fixed to the diaphragm, a first connection portion, and a second connection portion, wherein an outer periphery of the framework main body extends away from the diaphragm to form the first connection portion, an inner periphery of the framework main body extends away from the diaphragm to form the second connection portion, the elastic supporter is connected to the first connection portion, and the voice coil is connected to the second connection portion.

5. The sounding device as described in claim 4, wherein notches are formed at the second connection portion, and the second connection portion are separated by notches into a plurality of isolation islands that is spaced apart from each other, and the voice coil is fixed to the plurality of isolation islands.

6. The sounding device as described in claim 1, wherein the elastic supporter further comprises a flexible printed circuit board, wherein the flexible printed circuit board comprises a retaining portion connected to the first fixed portion, a bonding portion fixed to the second fixed portion, and an elastic arm connecting the retaining portion with the bonding portion; an opening of the suspension portion faces towards the flexible printed circuit board; and an orthographic projection of the elastic arm on the auxiliary diaphragm is located within the suspension portion.

7. The sounding device as described in claim 6, wherein a framework is connected to one side of the diaphragm facing towards the voice coil, and the voice coil and the elastic supporter each are connected to the framework.

8. The sounding device as described in claim 7, wherein the framework comprises a framework main body fixed to the diaphragm, a first connection portion, and a second connection portion, wherein an outer periphery of the framework main body extends away from the diaphragm to form the first connection portion, an inner periphery of the framework main body extends away from the diaphragm to form the second connection portion, the elastic supporter is connected to the first connection portion, and the voice coil is connected to the second connection portion.

9. The sounding device as described in claim 8, wherein notches are formed at the second connection portion, and the second connection portion are separated by notches into a plurality of isolation islands that is spaced apart from each other, and the voice coil is fixed to the plurality of isolation islands.

10. The sounding device as described in claim 6, wherein the flexible printed circuit board is located between the auxiliary diaphragm and the diaphragm.

11. The sounding device as described in claim 10, wherein a framework is connected to one side of the diaphragm facing towards the voice coil, and the voice coil and the elastic supporter each are connected to the framework.

12. The sounding device as described in claim 11, wherein the framework comprises a framework main body fixed to the diaphragm, a first connection portion, and a second connection portion, wherein an outer periphery of the framework main body extends away from the diaphragm to form the first connection portion, an inner periphery of the framework main body extends away from the diaphragm to form the second connection portion, the elastic supporter is connected to the first connection portion, and the voice coil is connected to the second connection portion.

13. The sounding device as described in claim 12, wherein notches are formed at the second connection portion, and the second connection portion are separated by notches into a plurality of isolation islands that is spaced apart from each other, and the voice coil is fixed to the plurality of isolation islands.

14. The sounding device as described in claim 1, wherein the magnetic circuit unit further comprises an upper clamp plate covering the auxiliary magnetic body and fixed to the frame, and a pole plate covering the main magnetic body, wherein the upper clamp plate has a through hole where the pole plate is located.

* * * * *